US011998065B2

(12) United States Patent
Gladney

(10) Patent No.: US 11,998,065 B2
(45) Date of Patent: Jun. 4, 2024

(54) ASSISTIVE GARMENT

(71) Applicant: Janice Gladney, Coppell, TX (US)

(72) Inventor: Janice Gladney, Coppell, TX (US)

( * ) Notice: Subject to any disclaimer, the term of this patent is extended or adjusted under 35 U.S.C. 154(b) by 253 days.

(21) Appl. No.: 17/316,667

(22) Filed: May 10, 2021

(65) Prior Publication Data

US 2021/0259327 A1 Aug. 26, 2021

Related U.S. Application Data

(63) Continuation-in-part of application No. 16/431,654, filed on Jun. 4, 2019, now abandoned.

(51) Int. Cl.

| | |
|---|---|
| ***A41B 9/00*** | (2006.01) |
| ***A41B 11/14*** | (2006.01) |
| ***A41D 1/06*** | (2006.01) |
| ***A41F 9/02*** | (2006.01) |

(52) U.S. Cl.

CPC ..... *A41B 9/001* (2013.01); *A41F 9/025* (2013.01); *A41B 11/14* (2013.01); *A41B 2300/32* (2013.01); *A41B 2400/44* (2013.01); *A41D 1/06* (2013.01)

(58) Field of Classification Search

CPC .... A41D 27/00; A41D 27/22; A41D 2400/44; A41D 1/06; A41D 13/0007; A41B 9/00; A41B 9/14; A41B 11/00; A41B 2400/44; A61F 3/02; A61F 9/005; A61F 9/002; A61F 13/00

See application file for complete search history.

(56) References Cited

U.S. PATENT DOCUMENTS

| | | | | |
|---|---|---|---|---|
| 2,643,383 | A * | 6/1953 | Brzozowski | A41C 1/02 450/143 |
| 3,487,474 | A * | 1/1970 | De Meo | A41F 9/005 2/311 |
| 4,258,440 | A * | 3/1981 | McGowan | A41D 13/1236 2/403 |
| 6,044,491 | A * | 4/2000 | Emery | A41C 1/02 2/46 |
| 6,167,572 | B1 * | 1/2001 | Naumovitz | A41D 1/06 2/300 |
| 9,675,126 | B2 * | 6/2017 | Allen | A41F 9/007 |
| 2007/0220659 | A1 * | 9/2007 | Ehmsen | A41B 9/007 2/400 |
| 2009/0313743 | A1 * | 12/2009 | Hofmeyer | A41D 27/20 2/250 |
| 2013/0007939 | A1 * | 1/2013 | Martinez | A41D 13/1245 2/128 |
| 2019/0021423 | A1 * | 1/2019 | Fayle | A41F 9/025 |
| 2021/0360982 | A1 * | 11/2021 | Princic | A41B 9/001 |
| 2021/0386128 | A1 * | 12/2021 | Dickson | A41F 9/025 |
| 2021/0401650 | A1 * | 12/2021 | Thompson | A41F 9/005 |

FOREIGN PATENT DOCUMENTS

| | | | | |
|---|---|---|---|---|
| GB | 2455435 | A * | 6/2009 | G09F 3/00 |

* cited by examiner

*Primary Examiner* — Katherine M Moran

(74) *Attorney, Agent, or Firm* — Amy Fiene; James Sonntag

(57) ABSTRACT

An assist garments worn on or below the waist has finger loops mounted on a band to assist in dressing and undressing.

20 Claims, 16 Drawing Sheets

ASSISTIVE GARMENT

BACKGROUND

For various reasons, individuals may have limited upper body range of motion. For example, movement impairment may result from-neurological diseases such as Multiple Sclerosis (MS), Parkinson's disease, Amyotrophic Lateral Sclerosis (ALS), or Guillian Barre Syndrome. Alternatively, it may result from a medical brain-related condition such as a CVA (Cerebral Vascular Accident—Stroke) or Post-Concussion Syndrome (PCS) or an auto-immune disorder such as rheumatoid arthritis. Even a standard medical procedure such as a shoulder replacement or a rotator cuff tear protocol may cause a movement impairment and may be temporary or long term.

The signs of movement impairment may include an absence of muscle strength in lifting everyday objects, such as a book or hairbrush. Diminished spatial awareness also may occur where the brain misperceives and analyzes information about the objects around them. Visual processing of that information to guide hand movements results in poor eye-hand coordination. Fine motor skills in small movements such as handwriting and holding a fork steady can become great tasks. Gross motor deficits in larger body parts such as arms and legs can affect running and walking.

A major concern of an individual with limited mobility of the upper body is the loss of their independence with lower body dressing. The individual's sense of worth and self-esteem diminishes as one of the simplest tasks cannot be performed i.e., donning their inner or outer garments when toileting or dressing themselves.

Regaining an individual's independence could decrease the need for an assistant/caregiver paid/unpaid, which could mean the difference between being placed in a skilled nursing home, assisted living facility or remaining independent at home. The essential ability of being able to dress or toilet oneself will tremendously elevate one's self-worth, self-esteem, and reduce the onset of depression. An individual's quality of life will increase as they improve one of the basic activities of daily living skills i.e., dressing and toileting themselves.

BRIEF DESCRIPTION OF DRAWINGS

The following is a description of drawings according to principles described herein.

FIG. **14*a*** illustrates a front view of an assistive garment with a plurality of loops, according to principles described herein.

FIG. **14*b*** illustrates an assistive garment being pulled onto a lower body, according to principles described herein.

Figure 15:
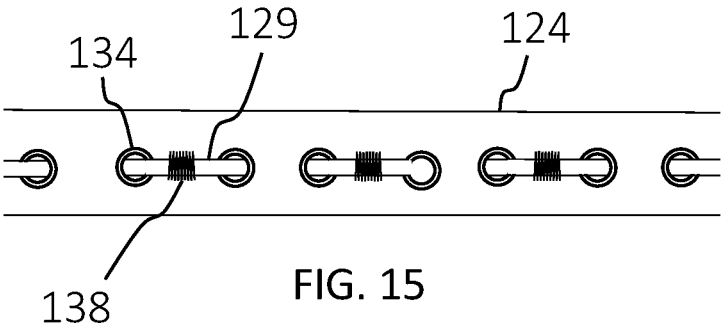

FIG. 15 illustrates a back view of an adjustable band having a plurality of loops, according to principles described herein.

Figure 16:
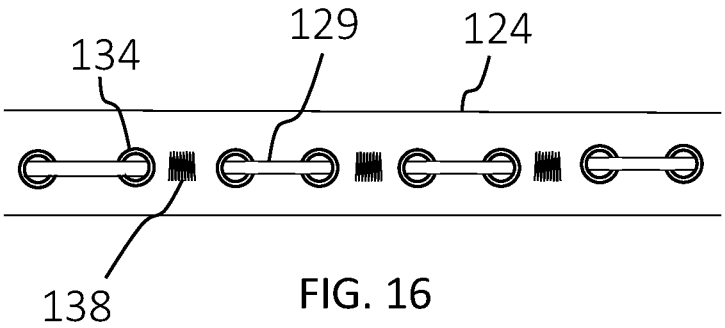

FIG. 16 illustrates a front view of an adjustable band having a plurality of loops, according to principles described herein.

Figure 17:
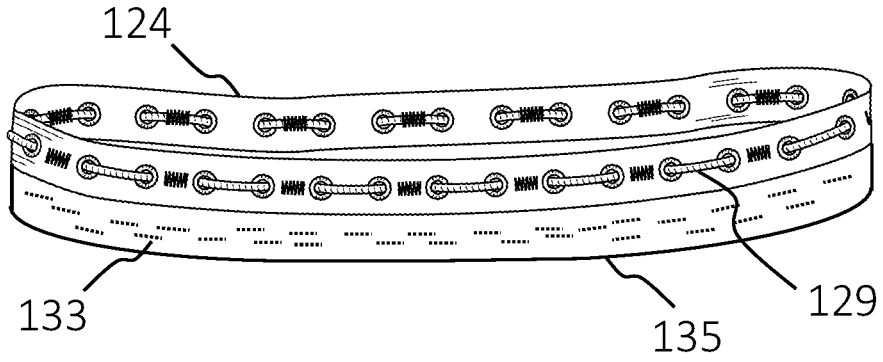

FIG. 17 illustrates a front view of an assistive garment, according to principles described herein.

Figure 18:
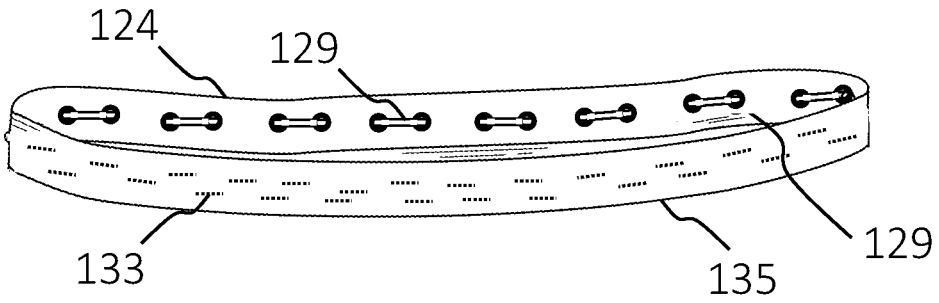

FIG. 18 illustrates a front view of an assistive garment, according to principles described herein.

Figure 19:
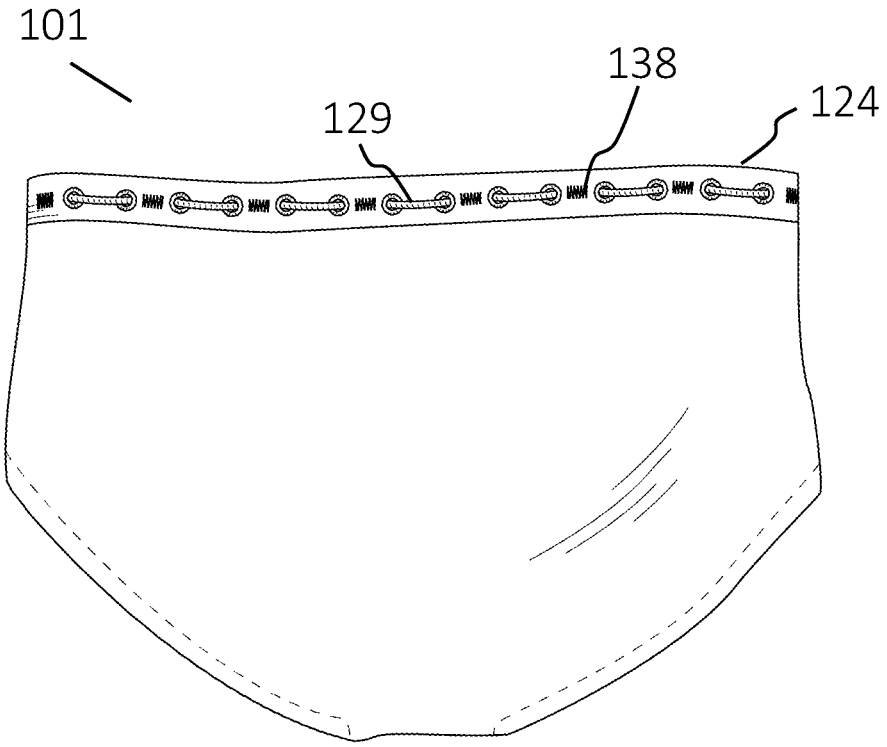

FIG. 19 illustrates a back view of an assistive garment having a plurality of loops, according to principles described herein.

Figure 20:
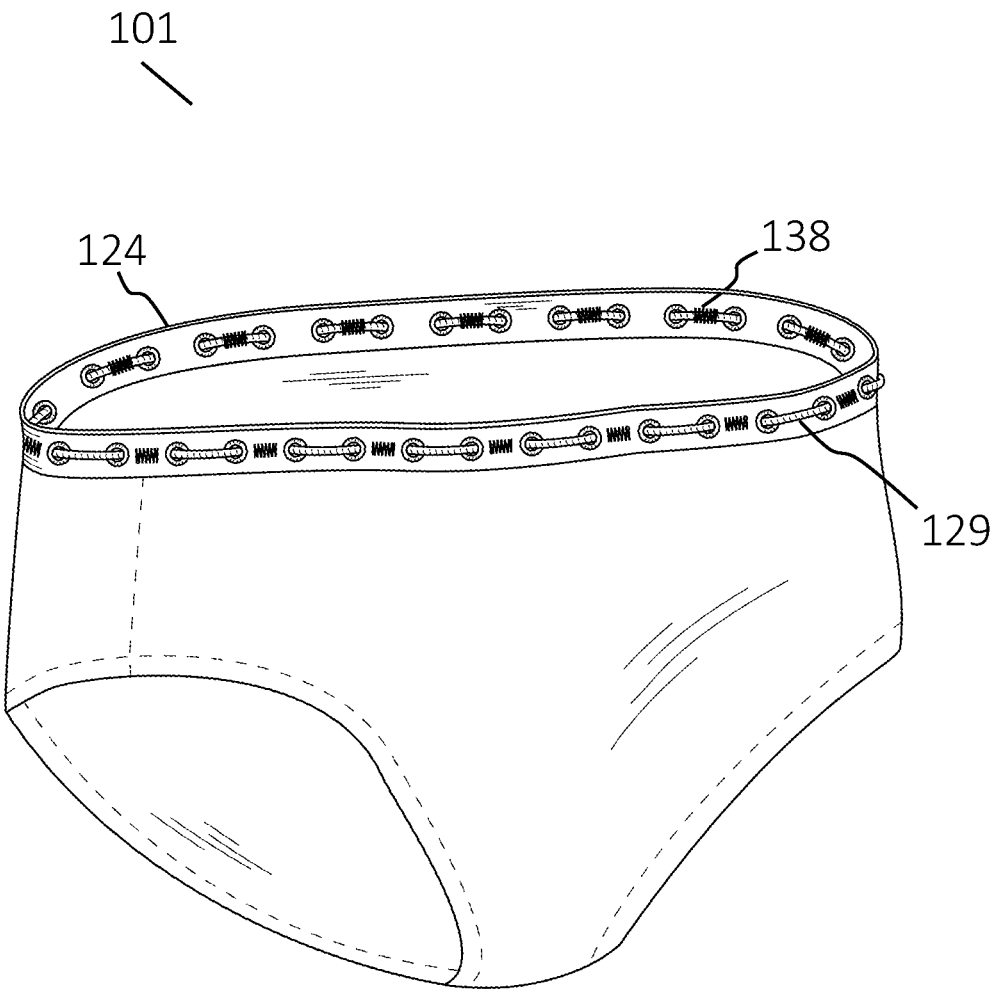

FIG. 20 illustrates a perspective view of an assistive garment having a plurality of loops, according to principles described herein.

Figure 21:
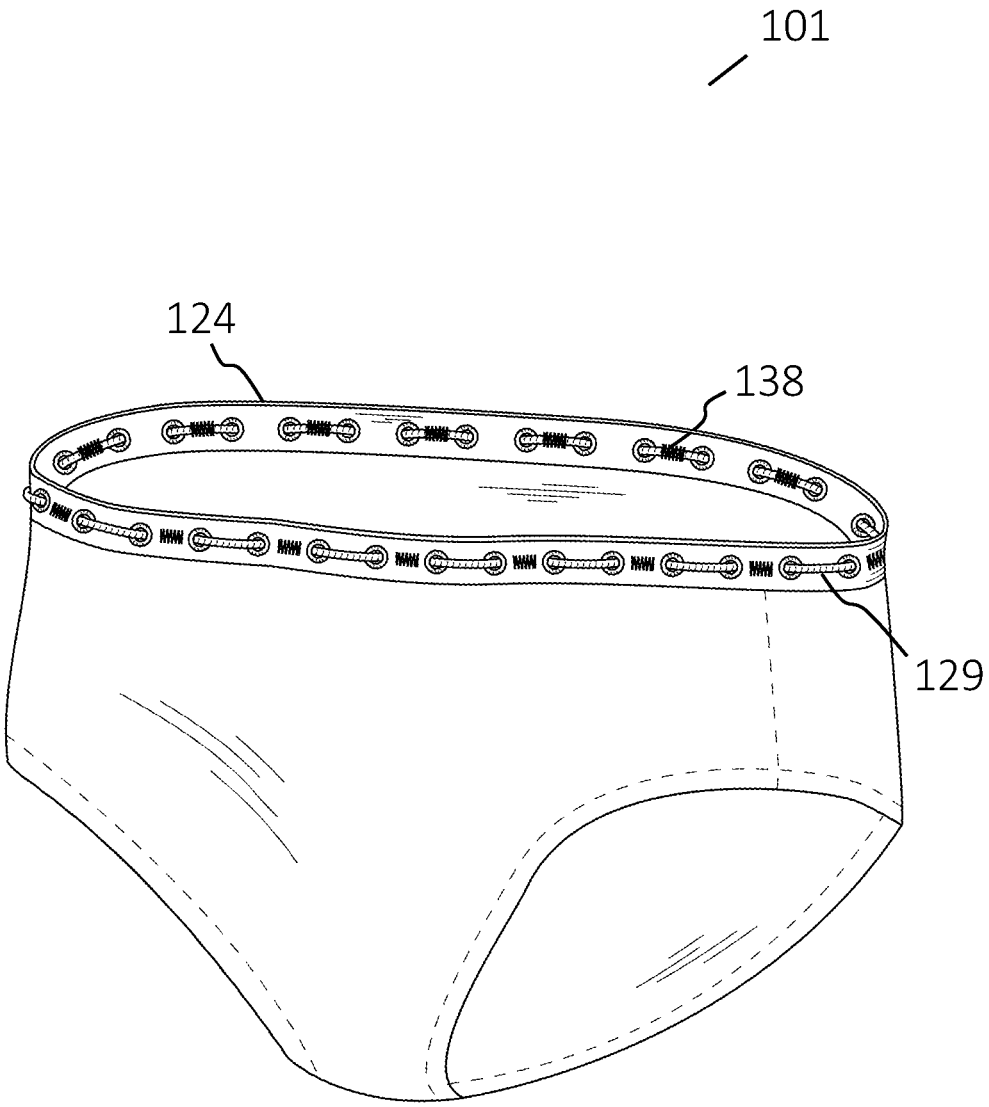

FIG. 21 illustrates a perspective view of an assistive garment having a plurality of loops, according to principles described herein.

Figure 22:
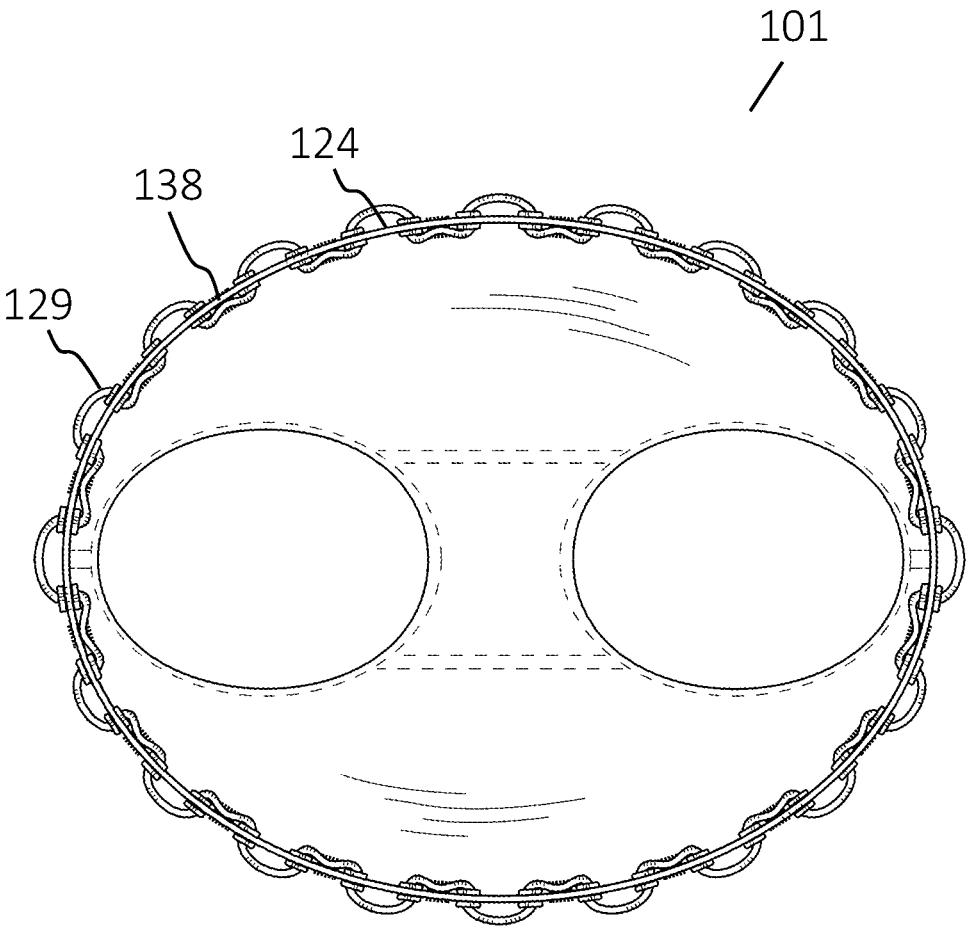

FIG. 22 illustrates a top view of an assistive garment having a plurality of loops, according to principles described herein.

Figure 23:
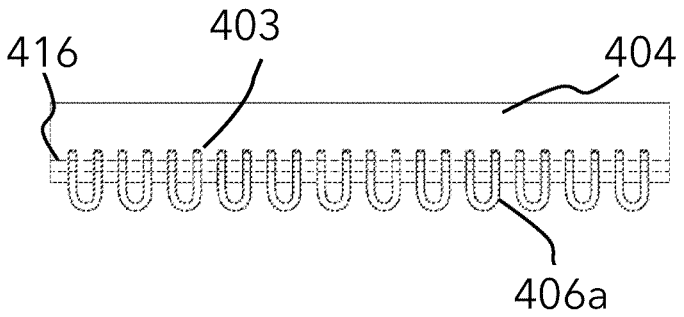

FIG. 23 illustrates a band with a plurality of loops, according to principles described herein.

DETAILED DESCRIPTION

The following relates to an assistive garment that is designed for clothing or adapted to existing clothing for individuals with limitations or disabilities dressing their lower body. For example, exemplary assistive garments assist in the donning inner and outer clothing over hips, tights over legs, socks over feet, etc.

The assistive garment is beneficial for individuals with hand and finger weakness, sensory impairment, fine and/or gross motor coordination impairments and shoulder limitations. Such a garment can be used by individuals of all ages particularly for the disabled community, but not limited to disabled individuals.

An assistive garment that includes a plurality of spaced loops along the circumference of inner and outer garments, incontinence diapers, lower body active wear, socks, half-slips, socks hosiery, and more, will improve one's independence with limited mobility, strength, coordination and dexterity or sensation of the upper body.

The assistive garment will assist an individual to improve lower body dressing, which can be particularly helpful for individuals with limited upper body mobility, strength, fine/gross motor coordination or sensory impairments. The goal is to help individuals transition back to independent living and acclimate to their 'new normal,' that is, a desirable form of independence made possible with lower body dressing aids.

An exemplary assistive garment has loops (e.g., 0-0.5, 0.5-1.0 inch, etc.) to insert a finger. Loops are spaced (e.g.

0-1, 1- to 2-inches, etc.) around the circumference of the garment for ease of use. Assistive undergarments can come in various shapes and sizes for male, females, adults, adolescents, toddlers, children, babies and infants. The undergarments are meant for not just the disabled community, but anyone having problems with lower body dressing.

An exemplary assistive garment may include a Self-Support Loop Strip that is meant to be attached to an existing garment. The Self-Support Loop Strip is a Velcro® strip, hook and loop, that can be cut into the appropriate length and be used with the strip to attach the loops to existing garments. The strip may incorporate adhesive bonding or heat bonding to attach the loops to existing garments. The assistive garment, whether as a strip or as attached to a garment, is ideal for individuals who suffer from various neurological diseases as well as individuals with hand sensory impairment, gross or fine motor coordination impairment, or limited shoulder movement. Impaired individuals can have a better quality of life when they improve their day-to-day independence with lower body dressing using the present looped garments or the Self-Support Loop Strips.

An aspect includes an assistive garment which comprises a lower body garment with a circumferential band adapted for wear around a lower extremity of a user. The band is attached to the lower body garment at edges of a top opening of the lower body garment, with a plurality of finger loops attached along edges of the band. Each loop of the plurality of finger loops provides a space for a finger to be inserted to pull the finger loop to lift or lower the lower body garment relative to a body of the user.

In an example, the band is a circumferential band adapted for wear that encircles a lower extremity of a user (e.g., waist, thigh, ankle, etc.). The band is attached to a lower body garment to be worn on the lower extremity. The band is attached at or near a top opening of the lower body garment. A plurality of finger loops are attached along the band and spaced equally apart. Each finger loop is connected to the band at endpoints so as to be functionally independent from the other finger loops of the plurality of finger loops. The endpoints extend horizontally relative to the band. The plurality of finger loops are dimensioned for a finger to be inserted to pull and thus lift or lower the lower body garment relative to a body of the user.

Each finger loop includes elastic properties such that a finger may pull each finger loop outward and upward from the band with a natural state of each finger loop being returned to upon its release. Each finger loop provides a space for a finger to be inserted to pull the finger loop to lift or lower the lower body garment relative to a body of the user.

In an example, holes are spaced around the band. An elastic strip is interwoven through the holes in the band to define the plurality of finger loops. Examples include that the holes be spaced equally apart from each other by a finger loop length around the band. Further examples include that the hole be riveted.

In another example, an assistive garment includes a lower body garment. A band with riveted holes is attached around a waist portion of the lower body garment. An elastic strip is interwoven through the riveted holes in the band to define a plurality of finger loops along the waist band where the elastic strip emerges from a riveted hole in the band and passes into and through an adjacent rivet on the band. Adjacent finger loops alternate between either side of the band formed by securing the elastic strip on either side of the rivets. Each finger loop provides a space for a finger to be inserted to pull the loop to lift or lower the lower body garment relative to a body of the user. The finger loops have elasticity and resiliency to be stretched from a natural state by fingers for donning the lower garment and then returning to the natural state.

In another example, an assistive garment includes a band with riveted holes. An attachment is to attach the band around a top opening of a lower body garment. An elastic strip is interwoven through the riveted holes in the band to define a plurality of finger loops along the band where the elastic strip emerges from a riveted hole in the band and passes into and through an adjacent rivet on the band. Adjacent finger loops alternate between either side of the band formed by securing the elastic strip on either side of the rivets. Each finger loop provides a space for a finger to be inserted to pull the loop to lift or lower the lower body garment relative to a body of the user. The finger loops have elasticity and resiliency to be stretched from a natural state by fingers for donning the lower garment and then returning to the natural state.

In another example, an assistive garment includes a lower body garment having a circumferential band adapted for wear on an existing band of a user. The band is attached to the lower body garment at edges of the existing band of the lower body garment. A plurality of finger loops are attached on the band at equally spaced intervals. Each finger loop is connected to the band at endpoints such that the finger loops are functionally independent of the other finger loops. Each finger loop includes horizontal endpoints relative to the band. Also, each finger loop is elastic such that a finger may pull each finger loop outward and upward from the band with a natural state of each finger loop being returned to upon its release. Each finger loop provides a space for a finger to be inserted to pull the loop to lift or lower the lower body garment relative to a body of the user.

In an example, the assistive garment further includes a plurality of riveted holes, each finger loop emerging from a set of two adjacent riveted holes, a securement for each finger loop located on the band outside of the two riveted holes or directly on the riveted holes. In an example, the riveted holes include at least one of rivets, grommets, or eyelets.

In an example, a securement is used to attach alternating finger loops to the band, such that corresponding alternating finger loops are pulled independently with respect to each other. Depending on the securement, the effect is that all outward facing loops or all inward facing loops are independent of each other. For inner securements, the outward facing loops are independent. For outer securements, the inner facing loops are independent.

In an example, the band is attached at edges of the top opening of the lower body garment. The top edges of the band may align with top edges of the top opening. The band may instead be located above or below the top edges of the top opening such that top edges of the band may be above or below the edges of the top opening. In another example, the band is attached to an existing band of the lower garment and may be attached in alignment with the existing band. For a lower garment with a waist band, an example band attaches or mates with the waist band. In another example, the top or bottom edge of the band is attached to a top or bottom edge of the existing waist band. In another example, the band is attached in an overlapping manner with the existing waist band. In another example, the band replaces the existing band of a lower garment. For example, for a lower garment with a waist band, the band replaces the waist band.

The lower body garment of the present assistive garment may be any suitable garment construction worn from or below the waist and designed to cover the waist and/or leg. To put such a garment on, it can frequently involve putting a foot into a top opening of the garment and pulling up on the garment. The garment includes those designed for males, females, adults, adolescents, toddlers, children, babies and infants. Examples include underwear, incontinent diapers (e.g., boxer shorts, briefs, panties, jockstraps, thongs, lingerie, long johns, compression stockings, pantyhose, slips, half-slips, girdles, etc.), inner and outerwear (e.g., swim wear, swimsuits, swimwear, trunks, shorts, active wear, skirts, loincloths, hose, socks, stockings, pants, etc.), and the like. Any garment that is donned on the lower body is anticipated.

The band supports the finger loops and the lower body garment. The band may be a simple panel construction but may also include structure for supporting the garment on the body. Suitable constructions include alone or in combination hems (including hems at the top opening of the lower body garment), support or draw strings, belt buckles, hooks, buttons, latches, closed strip designs, elastic or non-elastic waist bands, and the like. The band may further include a reinforced attachment or seam to the lower body garment to form a strong securement between the band the lower body garment. In an example, a double-stitched seam is used for attachment.

The material of the band may include properties of being elastic, non-elastic, semi-rigid, and rigid, but should be such that the assistive garment is capable of being put on and worn. Examples include non-rigid materials (natural and synthetic fabrics, elastic and non-elastic materials) and include rigid materials (metal, plastic, wood, etc.). Pliable and flexible materials, such as films, cloths and textiles used in clothing are suitable.

Attachment between the lower body garment and the band may be accomplished with a permanent or removable attachment. The band may be incorporated as an integral part of the edge of the top opening of the lower body garment, or otherwise permanently attached. The attachment may be in the form of one or more of a hem, adhesive strip, additional layers of fabric, or any other suitable construction that is also suitable for attachment of the finger loops. Removable attachments include Velcro®, hook and loop, removable or non-removable adhesive bonding, heat bonding, hooks, buttons, and the like. A removable design may also be removable while the assistive garment is being worn.

The band may also include circumference adjustment systems to conform the band to various waist sizes, such as adjustable belt or straps (as further described below). Alternately, an assistive garment may also have a separate circumference adjustment, such as a conventional belt, and belt loop system.

Pre-existing garments may be modified by attaching a band to the top opening or modifying the top opening of the garment, which becomes the lower body garment. If the pre-existing garment has construction at the top opening that can function as a band, finger loops can be attached directly to the band and top opening.

The finger loops are designed to be accessible, easily found, and provide structure for insertion of a finger or fingers, while the person is pulling the garment on or off. Accordingly, the finger-loops may be positioned on the band and be of a number to fit this requirement. Due to the different needs and abilities of the wearer, a "universal" placement where closely spaced finger loops are attached around the circumference of the band is suitable. The location and spacing of the finger loops may be dependent upon the style, appearance, and function of the assist garment. However, there must be at least one accessible finger loop, and finger loops must be spaced to not materially compromise loop function and the ability to finger grasp a loop.

Finger loops may extend upward for easier use but may optionally be extending down under the band when worn. For example, the band may be attached around bottom circumferential edges to the interior surface of the waist or hip portion (e.g., waist band, etc.) of the garment so that the band may pivot around the bottom circumferential edges and may be folded underneath the garment when the garment is being worn. This serves to effectively hide the band when a garment is being worn.

Variations include that one or more loops extend downward relative to the band instead of extending upward. Moreover, the band may include both loops that extend upward as well as loops that extend downward relative to the band.

Example placement of finger loops include at least two loops in the front and two loops in the back, the loops located where belt loops or attachment of suspenders would be. A loop or more than one loop may be located between a midline of a central body axis and a lateral side of the body. In another example, one or more loops are located in one or more of the front center and back center of the band relative to placement on a body. In another example, one or more loops are located on one or more of the sides of the band relative to placement on a body. In another example, loops are spaced all around the band. The loops may be spaced equally apart so that a user may more readily assess the location of a loop when trying to grasp a loop.

The finger loops should allow a finger hold to sufficiently exert an adequate pulling force for dressing and undressing. The material of the finger loops should be compatible with this function and may be strong, elastic or nonelastic, flexible or semi-rigid or rigid cords or strips, made from a fiber or fabric. The dimensions of the loops may be consistent with known clothing standards for finger dimensions. The finger loops are attached by any suitable system to the band, such as by sewing, adhesives, or using metal or plastic fasteners. The attachments of the finger loops may be optimized for user comfort, and for appearance. The finger loops, and band may have a thin construction and be unnoticeable under an overlying garment. The finger loops may be hidden behind the band so that they are unnoticeable from the outer appearance of the garment.

Figure 1:
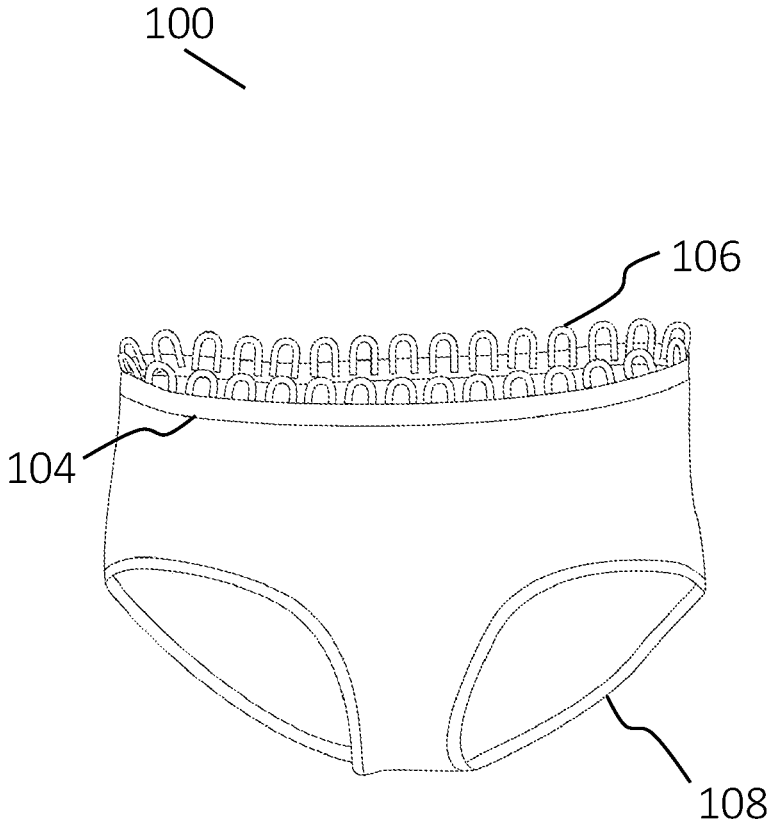
FIG. 1 illustrates a front view of an assistive garment, according to principles described herein.

Reference is now made to FIG. 1, which shows an exemplary female undergarment 100, showing a lower body garment 108, a band 104 around a top opening of the lower body garment, and a plurality of finger loops 106 each adapted for insertion of a finger for pulling on the undergarment when dressing or undressing.

Figure 2:
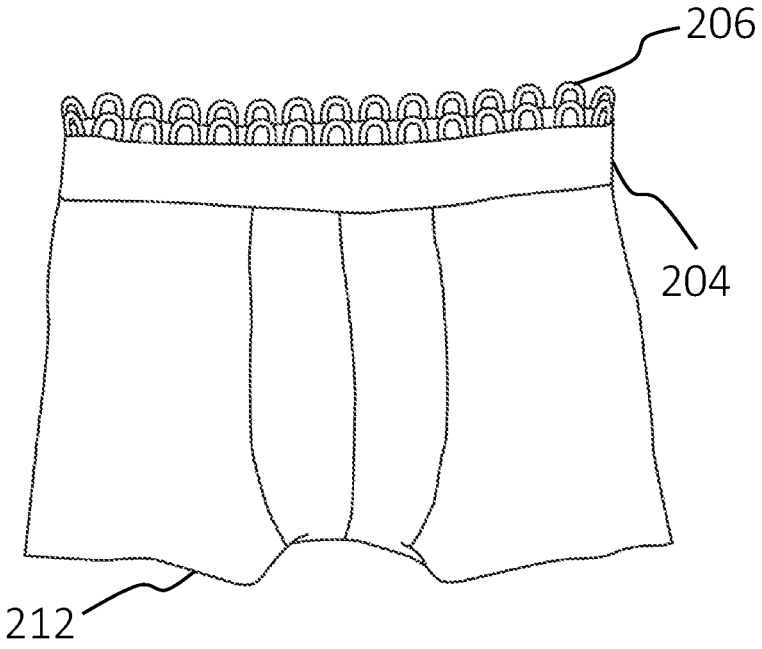
FIG. 2 illustrates a front view of an assistive garment, according to principles described herein.

Reference is now made to FIG. 2, which shows an exemplary male undergarment 200, showing a band 204 attached to a top opening of a lower body garment 212. Finger loops 206 are attached to the upper edge of the band, providing a means to pull the undergarment up or down by inserting a finger or multiple fingers in one or more finger loops 206.

Figure 3:
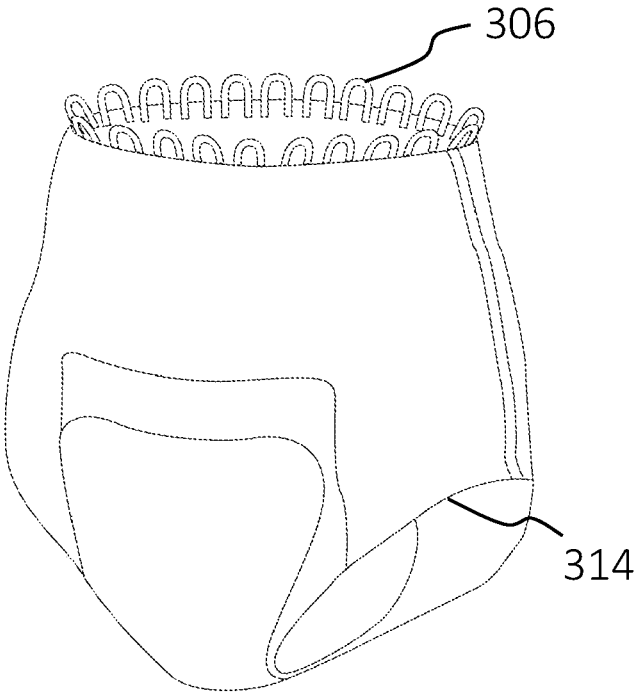
FIG. 3 illustrates a perspective view of an assistive garment, according to principles described herein.

Reference is now made to FIG. 3, which shows an exemplary garment 300 of male or female incontinent diapers. Here, the band 304 is incorporated in the lower body garment 314 formed at the edge of the top opening by, for example, at adhesive, edge stitching, top stitching, or other suitable means. The construction for forming the band, may also be used fully or partially for attachment of the finger loops 306.

Figure 4:
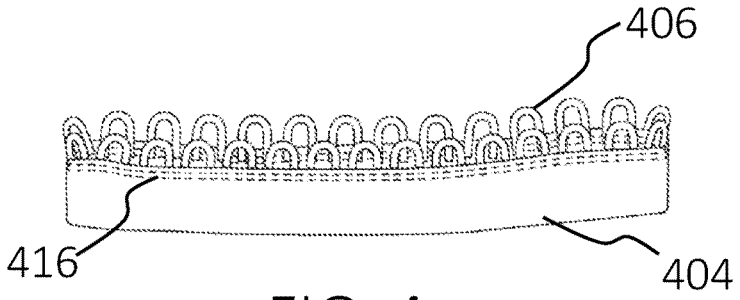
FIG. 4 illustrates a band with a plurality of loops, according to principles described herein.

Reference is now made to FIG. 4, which shows an example of band 404 and finger loop 406 construction. At the upper edge of the band 404 are loops 406. The loops 406 are formed as inverted U shapes with downward extending ends overlapping the band 406.

The loops are made to fit a standard person. A standard person is a mathematical model of a person based on any suitable data that simulates a person's size, body proportions, and the like. The model can be based upon data, for example, used in the clothing industry to define sizes for apparel, gloves, and the like. The standard person used and the data set used to derive the standard person is chosen with the user of the medical garment bottom in mind and can be based upon average values of body proportions from any sample of the population from, for example, total population, gender, age, body size or weight, nationality, or the like. The standard person may also be based upon any particular individual, or group of individuals. Thus, the standard person for a loop may be designed for marketing to the public in general, or be customized to fit a particular group of people, or to fit an individual.

The interior width of a finger space defined by each loop and measured at loop ends intersecting with the top edge of the band includes 0.75"-1.0", 1.0"-1.25", 1.25"-1.5", 1.5"-1.75", 1.75"-2.0", or 2.0"-2.5". Spacing between each loop as measured between side edges of each loop includes a range of heights from 0.01"-0.02", 0.02"-0.03", 0.03"-0.04", 0.05"-0.06", 0.06"-0.07", 0.07"-0.08", 0.08"-0.09", and 0.09"-1.0". A height of the loop as measured from the top edge of the band includes various range heights. Examples include a range height from 0.5"-0.6", 0.6"-0.7", 0.7"-0.8", 0.8"-0.9", 0.9"-1.0", 1.0"-1.5", 1.5-2.0", 2.0"-2.5", and 2.5"-3.0", or a variation within this range height.

Figure 5:
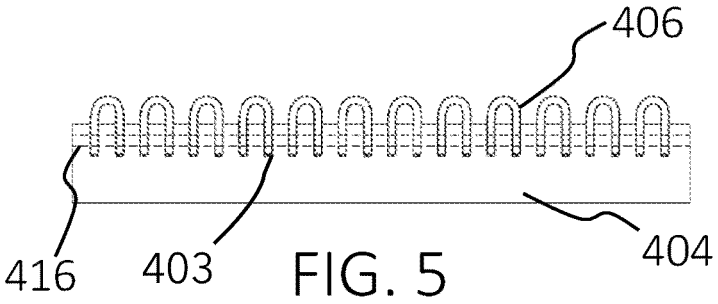
FIG. 5 illustrates a band with a plurality of loops, according to principles described herein.
Figure 6:
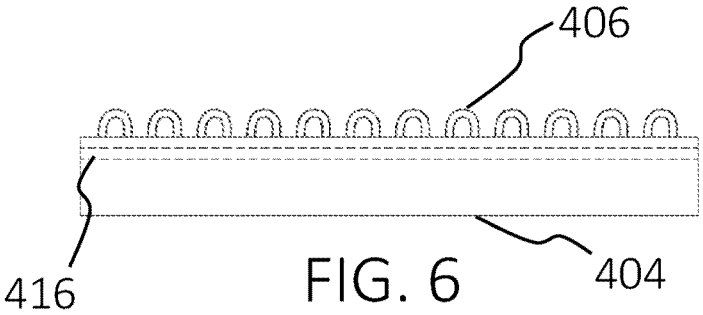
FIG. 6 illustrates a band with a plurality of loops, according to principles described herein.

One or more chain stitches 416 (e.g., doublestitch, etc.) paralleling the top of the edge, or an equivalent attachment, are sewn over or through the legs and underlying band to attach both ends forming a finger loop 406. The stitching shown 416 may also be used to attach the band 404 to a lower body garment (not shown). FIG. 5 and FIG. 6 show respectively, two sides of the band 404, showing the stitches 416 and the finger loops 406. FIG. 5 shows the surface which would be on an inner facing surface on a garment in a convention construction, but the surface may also be on an outer facing surface. FIG. 6 shows the surface which would be on the outer facing surface on a garment in conventional construction (See FIG. 4), but the FIG. 6 surface may also be on the inner surface to present a smoother surface against the skin. In FIG. 5 each finger loop 406 is connected to the band at endpoints 403 so as to be functionally independent from the other finger loops. In FIG. 23, a band is shown which is identical in construction to the band shown in FIG. 5, except the finger loops 406*a* extend downward.

Figure 7:
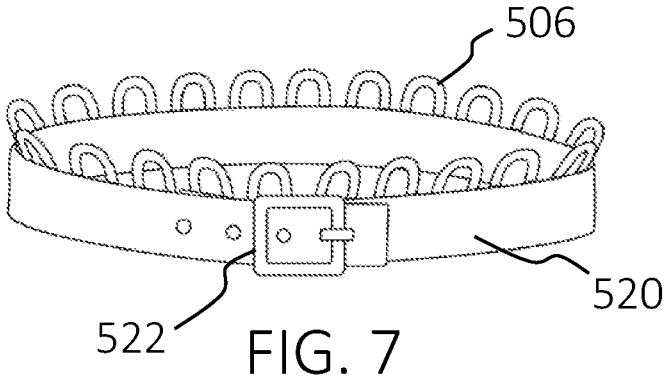
FIG. 7 illustrates an adjustable band with a plurality of loops, according to principles described herein.

Reference is now made to FIG. 7. In addition to the attachment of the finger loops, the band may also incorporate construction for maintaining the garment on the waist while being worn. This may include, for example, one or more of draw strings, elastic waist bands, and circumference adjustment systems (e.g. belts). FIG. 7 shows a band 520 with attached finger loops 506 with a circumference adjustment system 522 constructed as a conventional belt buckle. There are many alternate belt buckle designs for use for belts and apparel straps that are suitable. These include systems where the band 520 is formed by adjustably joining two ends of a strip to form the band 520.

Figure 8:
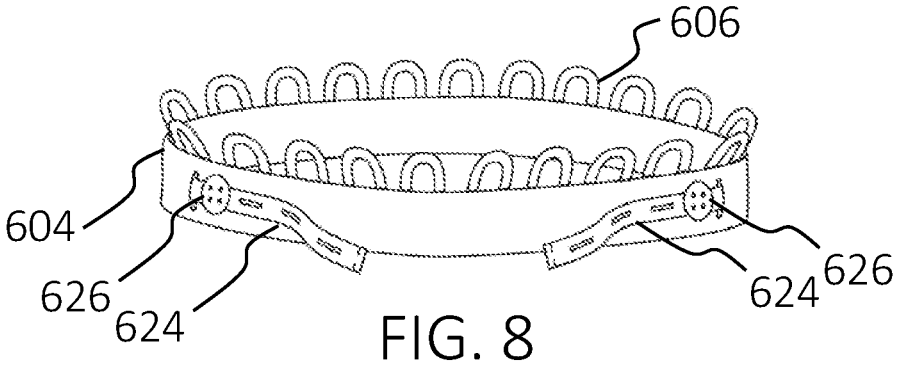
FIG. 8 illustrates an adjustable band with a plurality of loops, according to principles described herein.

FIG. 8 shows a band 604 with attached finger loops 606 with a circumference adjustment system comprising a cord or strip 624 passing through the interior of the band between apertures in the outer surface.

Where the strip exits through one or both apertures there may be a releasable locking or clamping structure to adjust the strip length, and thereby the band circumference. For example, the locking structure may be a button, snap, clip, hook, or other structure. The strip 624 may be elastic or non-elastic.

Figure 9:
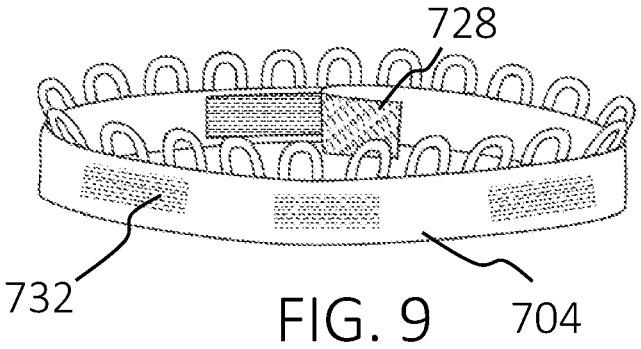
FIG. 9 illustrates an adjustable band with a plurality of loops, according to principles described herein.

FIG. 9 shows a band 704 with attached finger loops with a circumference adjustment system that is obtained by having joinable ends to form the band 704, as in FIG. 7. Here to ends are fitted with an adhesive bonding. Examples include a removable or non-removable adhesive bonding. As shown, the adhesive bonding is provided by hook-and-loop fasteners 728, such as Velcro®.

The lower body garment is not shown in FIG. 7, FIG. 8, or FIG. 9, but one can be attached to the band by any suitable means, such as by sewing, a bonding adhesive, hook-and-loop attachments, hooks, buttons, snaps, zippers, or the like. For example, the loop or hook portion in FIG. 9 may extend a portion of or the entire length of the strip forming the band with a matching loop or hook attachment near the top edge of the lower body garment. In an example, an adhesive bonding or heat bonding may be provided on the exterior of the band to attach the band to clothing. Exemplary patches of hook-and-loop fasteners 732 are shown on the exterior surface of the band 704 to be fastened to an interior surface of a waist or hip region of a garment having a corresponding hook-and-loop fastener (not shown). Instead of multiple patches, a contiguous strip of a hook-and-loop fastener may be used, or other type of fastener as described.

In other examples, an adhesive bonding material may be used to attach the band to a lower body garment. The adhesive bonding material may extend along a portion of the length or the entire length of the band. The adhesive bonding material may form a permanent or removable bond between the band and the lower body garment. In an example, the band is attached using a bonding material. The band may be ironed on to the lower body garment, which activates the bonding material to secure the band to the lower body garment. In an example, further bonding is incorporated with Velcro® or hook and loop material. In other examples, no other bonding is needed. In examples, no sewing or minimal sewing is required. In other examples, the band is sewn to the lower body garment.

Figure 10:
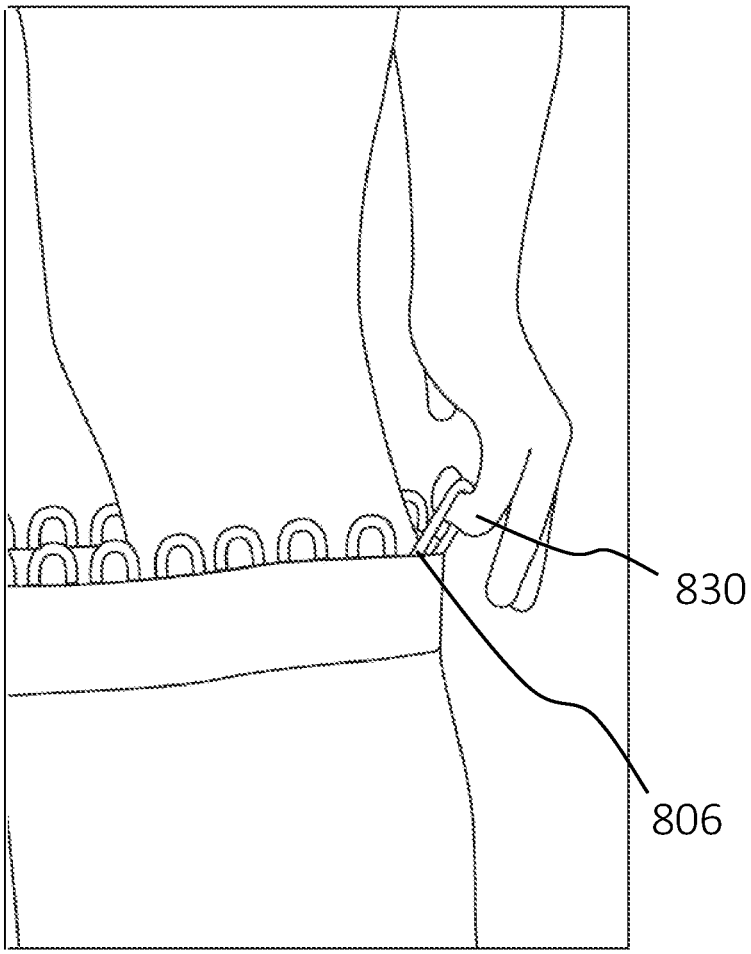
FIG. 10 illustrates an assistive garment being pulled onto a lower body, according to principles described herein.

FIG. 10 shows one finger 830 lifting the garment 806. This demonstrates the advantage of the assistive garment in that only a single hand, even a single finger 830, can be used to assist in getting dressed. By crossing the hand over to the other side of the garment and wrapping a hand behind the garment, a single finger or hand can be used to lift around sides of the garment to complete getting dressed and getting undressed.

Figure 11:
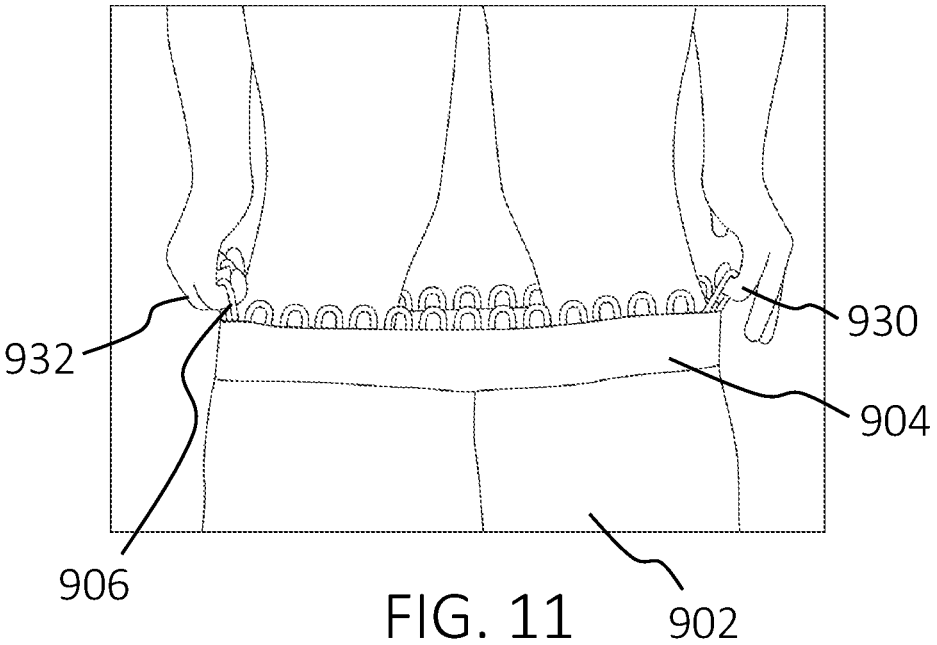
FIG. 11 illustrates an assistive garment being pulled onto a lower body, according to principles described herein.

FIG. 11 shows a garment comprising a band 904 with attached finger loops 906 and supporting a lower body garment 902, being pulled on by a wearer. Multiple fingers of the wearers left hand 932 are engaging at least two finger loops 906, and one finger of the right hand 930 is engaging a finger loop 906. Here is shown pulling up and putting on the garment. The loops are advantageous in that only a single finger can be used to lift the garment.

Figure 12:
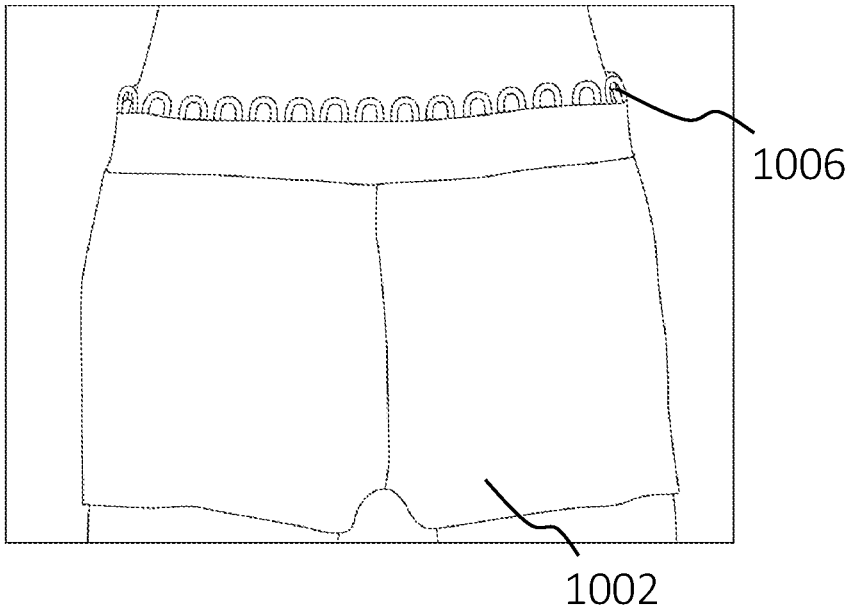
FIG. 12 illustrates an assistive garment being worn on a lower body, according to principles described herein.

FIG. 12 shows a garment 1002 that has been fully donned around a person's waist and hips. The loops 1006 may be directed vertically upward or inclined slightly toward the body or away from the body. To undress, the finger loops are similarly engaged and pulled down to remove the garment.

Figure 13:
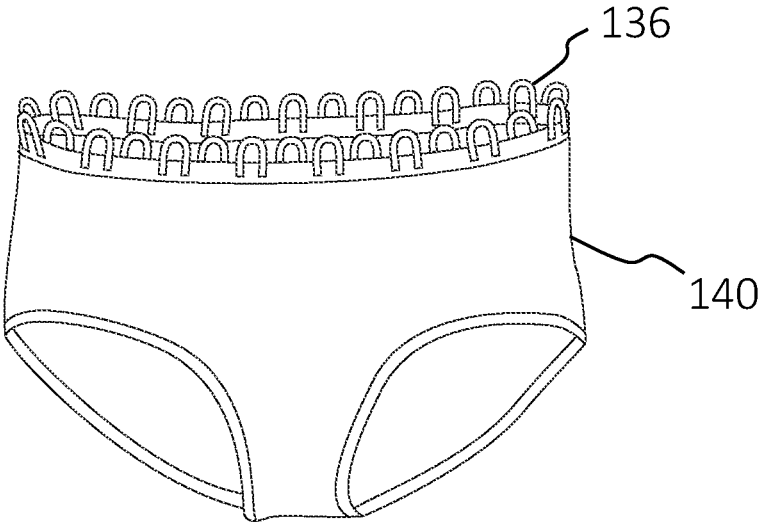
FIG. 13 illustrates a front view of an assistive garment with a plurality of loops, according to principles described herein.

FIG. 13 illustrates a garment 140 having finger loops 136 which alternate with every other loop being front and back, particularly, every other finger loop 136 being attached at ends on a front facing side and a back facing side of the band.

In an example, the loops do not extend past the top of the band. The loops behind the band are thus hidden behind the band. Loops in front of the band are not hidden but are not highly visible because they are within the bounds of the band.

Figure 14A:
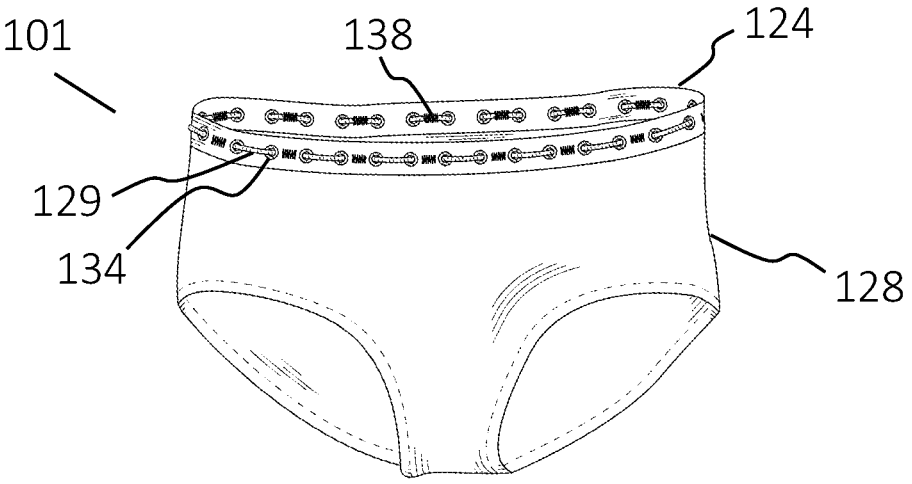

FIG. 14*a* illustrates a lower garment 101 with a band 124 that has holes which may be riveted holes 134 as shown. Interwoven in the riveted holes 134 is an elastic strip 129. The elastic strip 129 follows the band 124 and thus follows the curvature of the band 124. The band 124 is rounded so that it encircles a waist of a user. The band 124 may be removably or non-removably attached to an existing waist band of the lower garment 101. In another example, the band 124 is the waist band of the lower garment 101. The elastic strip 129 includes properties of having stretch and resilience to return to a natural state. While the band 124 is shown and described as a band around the waist, the principles described apply to any lower body garment or other article of clothing worn by a user.

In an example, the riveted holes 134 are equally spaced around the band 124. In an example, spacing is defined by finger loop intervals, so that the riveted holes are a finger loop length apart from each other. In an example, each pair of riveted holes 134 is equally spaced apart from each other around the band so that finger holes between each pair of riveted holes are spaced equally apart from each other. The space between each pair of riveted holes may be less than, equal to, or greater than, the space within a pair of riveted holes that allocate the space for each finger hole space.

The elastic strip 129 is interwoven in the riveted holes 134 of the band 124 around the lower garment 101. A finger loop is formed by the elastic strip 129 emerging from a riveted hole 134 in the band 124 and passing into and through an adjacent riveted hole 134 on the band 124. Adjacent finger loops alternate between either side of the riveted holes 134, each finger loop providing a space for a finger to be inserted to pull the finger loop to lift or lower the lower body garment relative to a body of the user. In this manner, the interwoven elastic strip 129 defines finger loops that alternate with every other finger loop being on a front facing side and a back facing side of the band 124. A user may thus grasp a finger loop on the front side or back side of the band 124 to pull up and off the garment 101.

As shown in FIG. 14*a*, stitches 138 are used in between each set of two riveted holes to secure the elastic strip 129 on the back side, or inner facing side, of the band 124 in between each finger loop. In other words, each finger loop is secured on either end to the back side of the band 124 by stitches 138. Finger loops are defined on the front side of the band 124 while the finger loops that would otherwise be accessible on the back side of the band are stitched to the back side of the band 124. Thus, the back side finger loops are used as securement for ends of the finger loops. The stitches 138 make it so each finger loop is accessed and pulled or otherwise manipulated independently without affecting or interfering with the rest of the elastic strip 129 and other finger loops.

In another example, the elastic strip 129 is attached directly to the riveted holes 134 instead of being directly attached to the band 124. Attachment may be to the rivet or through another structure. Stitches 138 may or may not be used.

The riveted holes 134 are holes in the band 124 that are protected by rivets that are spaced around the band 124. The riveted holes 134 are holes in the band 124 with edges of the holes being protected. Rivets as used herein, includes rivets, grommets, eyelets, and other members that protect edges of a hole in clothing or material, however, they are referred to only as rivets for purposes of the description herein. The rivets may include metal, plastic, or a combination thereof. The riveted holes 134 may be spaced equally or unequally around the band 124. In an example, the riveted holes are located in sets of two that are equally spaced around the band 124. Each pair of riveted holes 134 is spaced apart with the elastic strip 129 located between the two riveted holes 134. As stated above, the elastic strip 129 between each riveted hole 134 defines a finger loop for a standard user. The riveted holes 134 being equally spaced is to allow the user to gauge where to place fingers more easily than if the holes were spaced unequally.

In an example, the elastic strip 129 is replaced with a non-elastic strip. The strip may be a cord, a belt, or other type of element that wraps around a waist or lower body. The elastic strip 129 or other type of wrapping element may be removable or permanently attached to the band 124.

While the garment shown is a pair of underwear, other garments discussed herein may be used with the band 124.

Figure 14B:
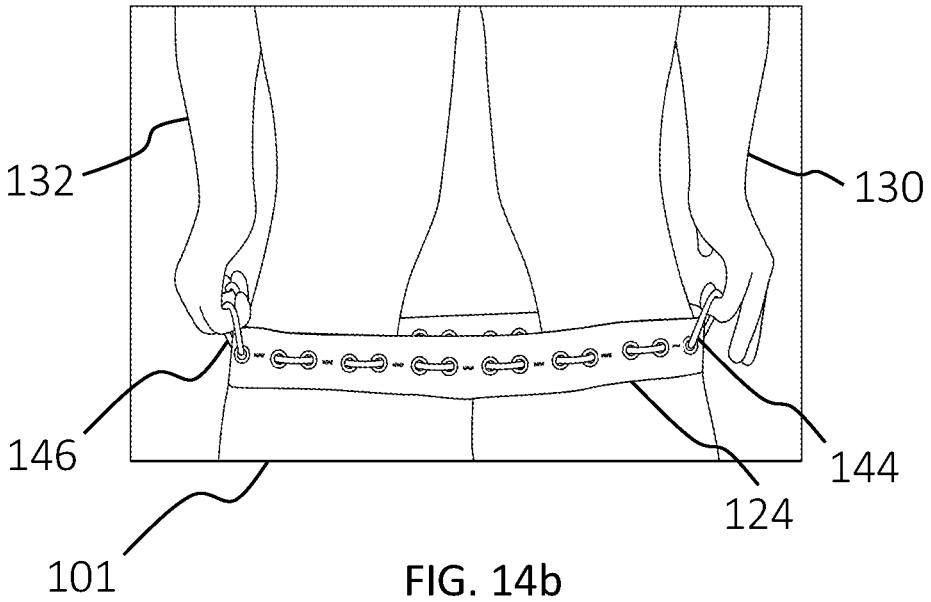

FIG. 14*b* shows a garment 101 comprising a band 124 with attached finger loops 146 as defined by the elastic strip 129 that are used by a user to pull the garment 101 upward on the lower body of the user. Multiple finger loops 146 may be grabbed as shown by the user's left hand. On the other hand, a single finger loop may be grabbed as shown by the user's right hand 144.

As noted above, the assistive garment is particularly useful for individuals with physical impairment due to a neurological insult to brain, orthopedic injury, surgical repair of the upper body, degenerative joint disease, auto-immune disease resulting in upper body weakness, limited range of motion, gross or fine motor coordination impairments and sensory impairments to one or both sides of their body. Target individuals may also be those who suffer from neurological diseases such as Strokes, Multiple Sclerosis, Parkinson's Disease, ALS, Guillian Barre Syndrome, Concussion Syndrome, shoulder replacement, rotator cuff tear protocol, and Rheumatoid Arthritis. More specifically, individuals who have limited upper body range of motion, strength and sensory impairments or coordination. The assistive garment can help these individuals gain independence with lower body dressing.

FIGS. 15 and 16 illustrates respective back view and front view of a band 124 to show the stitches 138 from the two views. From the front side in FIG. 16, the stitches 138 are located in between each finger loop. Behind the band 124, the stitches 138 secure the elastic strip 129 to the band 124. Thus, the stitches 138 appear as though they are on a finger loop on the back side. This is the organization for front facing finger loops to be grasped. Stitches on the front facing loops would be used for back facing finger loops. In other examples, a combination of stitches on a portion of the front facing finger loops and back facing finger loops may be used for both front and back facing finger loops to be accessed.

Stitches may be sewing stitches. In other examples, the stitches may take other forms of securement. Securement may include bonds, knots, staples, adhesives, for example. In an example, stitches are replaced by other locking structures. Locking structure may include permanent securement or removable securement. Also, locking structure may be adjustable or non-adjustable. Locking structures may be removable, such as buttons, snaps, clasps, or other locking structures. Locking structures may allow the elastic to be tightened or loosened to allow a shorter or tighter finger loop as desired. In another example, there are no stitches and finger loops are not tethered or secured between each other. This results in an elastic strip and finger loops that are not independent of each other. A pull on a finger loop will put strain on adjacent finger loops.

FIG. 17 illustrates an attachment 135 with adhesive bonding material 133 that may be used to attach the band 124 to a lower body garment. The adhesive bonding material 133 may be permanent or removable. The adhesive bonding material 133 may extend along a portion of the length or the entire length of the band 124. The adhesive bonding material 133 may form a permanent or removable bond between the band 124 and a lower body garment. As shown, the adhesive bonding material 133 is located on an attachment 135 to the band 124. The attachment 135 may be attached anywhere on the band 124. In FIG. 17, the attachment 135 is attached around bottom edges of the band 124. In FIG. 18, the attachment 135 is attached on top of the outer surface of the band 124. In both examples, the attachment 135 is used to attach the band 124 around an opening of an inner facing surface of a lower garment.

Note that in FIG. 18, the attachment 135 is shown as including an outer layer strip attached to the outer surface of the band 124. The finger loops 129 are covered on the exterior of the band 124. Thus, examples include that the finger loops 129 be available on the interior of the band 124. Examples further includes that the finger loops 129 on the exterior facing side of the band 124 be stitched or otherwise secured to make the interior finger loops 129 be independent from each other.

The attachment 135 may be a strip of material that is at or near the top of the opening of the lower garment. In an example, the attachment 135 is of a similar material as the lower garment. In another example, the attachment 135 is of the same or similar material as the band 124. In another example, the attachment 135 is an extension of the band 124. The attachment 135 may have a shorter width, same width, or greater width as the band 124.

Examples further includes that the attachment 135 be ironed on to the lower body garment, which activates the bonding material to secure the band to the lower body garment. In an example, bonding is incorporated with Velcro® or hook and loop material. In examples, there is no adhesive bonding material 133. Examples further include that the attachment 135 incorporates structure such as buttons, zippers, hooks, ties, or other structure to attach the band 124 to the lower garment. Also, the attachment 135 may be used to sew the band 124 may be sewn to the lower body garment.

FIG. 19 illustrates a back view of an assistive garment, according to principles described herein. FIG. 20 illustrates a perspective view of an assistive garment, according to principles described herein. FIG. 21 illustrates a perspective view of an assistive garment, according to principles described herein. FIG. 22 illustrates a top view of an assistive garment, according to principles described herein. Each view illustrates the finger loops 129, stitches, and band 124 as attached to a lower garment.

In summary, the present assistive garment is useful, and may be essential for personal independence for:

2.3 million individuals who suffer from Multiple Sclerosis
10 million individuals who suffer from Parkinson's Disease
15 million individuals who suffer from Strokes (CVA)
450,000 individuals who suffer from ALS
30,000 individuals who suffer from Guillian Barre Syndrome, and
Countless individuals who suffer from:
Rotator cuff tear & reverse shoulder replacements
Concussion syndrome
Sensory impairment
Rheumatoid Arthritis
Decreased-strength, fine motor and sensory impairments
Shoulder limitations While this invention has been described with reference to certain specific embodiments and examples, it will be recognized by those skilled in the art that many variations are possible without departing from the scope and spirit of this invention, and that the invention, as described by the claims, is intended to cover all changes and modifications of the invention which do not depart from the spirit of the invention.

What is claimed is:

1. An assistive garment, comprising:
a lower body garment;
a circumferential band adapted for wear that entirely encircles a lower extremity of a user, the band attached to the lower body garment at or near a top opening of the lower body garment and extending around the entire top opening; and
a plurality of finger loops attached along the band and spaced equally apart, each finger loop of the plurality of finger loops connected to the band at endpoints so as to be functionally independent from the other finger loops of the plurality of finger loops, the endpoints extending horizontally relative to the band, the plurality of finger loops dimensioned for a finger to be inserted to pull and thus lift or lower the lower body garment relative to a body of the user.

2. The assistive garment of claim 1, wherein each finger loop of the plurality of finger loops includes elastic properties such that a finger may pull each finger loop of the plurality of finger loops outward and upward from the band with a natural state of each finger loop of the plurality of finger loops being returned to upon its release, each finger loop of the plurality of finger loops providing a space for a finger to be inserted to pull the finger loop of the plurality of finger loops to lift or lower the lower body garment relative to a body of the user.

3. The assistive garment of claim 1, wherein the band comprises one or more of cotton, polyester, metal, plastic, or a combination thereof.

4. The assistive garment of claim 1, wherein the band is adjustable around the lower extremity such that a closed, rounded shape defined by the band may be increased or decreased.

5. The assistive garment of claim 1, wherein the band includes a reinforced attachment or seam to edges of a top opening of the lower body garment.

6. The assistive garment of claim 1, wherein the band is removably attached to top edges of the top opening of the lower body garment by one or more fastening structures.

7. The assistive garment of claim 1, wherein the band is adjustable in length by hook and loop fasteners.

8. The assistive garment of claim 1, wherein one or more of the plurality of finger loops include properties of being elastic or nonelastic, flexible, semi-rigid, or rigid.

9. The assistive garment of claim 1, wherein at least one finger loop is located in a front and back part of the garment.

10. The assistive garment of claim 1, wherein at least one finger loop extends downward relative to the band.

11. The assistive garment of claim 1, wherein the plurality of finger loops comprises a material that is of thin construction so as to blend underneath an overlying garment-and be unnoticeable.

12. The assistive garment of claim 1, wherein the lower body garment includes pants, skirts, half-slips, active wear bottoms, socks, underwear, incontinent diapers, swim bottoms, girdles, or hosiery.

13. An assistive garment, comprising:

a lower body garment;

a circumferential band adapted for wear configured to entirely encircle a lower extremity of a user, the band attached to the lower body garment at or near a top opening of the lower body garment; and a plurality of finger loops attached along the entire circumference of the band and spaced equally apart, each finger loop of said plurality of finger loops defined by an elastic strip interwoven through equally spaced holes formed through the band, such that finger loops alternate with every other finger loop being on a front facing side and a back facing side of the band, with finger loops defined on the front facing side of the band and the back facing side of the band, each finger loop of the plurality of finger loops attached to the band so as to be functionally independent from the other finger loops of the plurality of finger loops, the plurality of finger loops dimensioned for a finger to be inserted to pull and thus lift or lower the lower body garment relative to a body of the user.

14. The assistive garment of claim 13, wherein the holes are spaced equally apart from each other by a finger loop length around the band.

15. The assistive garment of claim 13, wherein the holes are riveted.

16. An assistive garment, comprising:

a band with riveted holes, the band attached around a top opening of a lower body garment by an attachment, an elastic strip interwoven through the riveted holes in the band to define a plurality of finger loops along the band where the elastic strip emerges from a riveted hole in the band and passes into and through an adjacent rivet on the band, with adjacent finger loops alternating between either side of the band formed by securing the elastic strip on either side of the rivets, each finger loop of the plurality of finger loops providing a space for a finger to be inserted to pull the loop to lift or lower the lower body garment relative to a body of the user, the plurality of finger loops having elasticity and resiliency to be stretched from a natural state by fingers for donning the lower body garment and then returning to the natural state.

17. An assistive garment, comprising:

a lower body garment;

a circumferential band the circumferential band attached to the lower body garment at edges of the existing band of the lower body garment; and a plurality of finger loops attached along the entire circumference of the circumferential band at equally spaced intervals, each finger loop connected to the circumferential band at endpoints such that the finger loops are functionally independent of each other, said endpoints for each finger loop of the plurality of loops are horizontal relative to the circumferential band, each finger loop being elastic such that a finger may pull each finger loop outward and upward from the circumferential band with a natural state of each finger loop being returned to upon its release, each finger loop providing a space for a finger to be inserted to pull the loop to lift or lower the lower body garment relative to a body of the user.

18. An assistive garment, comprising:

a lower body garment;

a circumferential band adapted for wear on an existing band of the lower body garment, the circumferential band attached to the lower body garment at edges of the existing band of the lower body garment; and a plurality of finger loops attached on the circumferential band at equally spaced intervals, each finger loop connected to the circumferential band a plurality of riveted holes, each finger loop emerging from a set of two of the riveted holes, securement of each finger loop being on the circumferential band outside of the two riveted holes or directly on the riveted holes such that the finger loops are functionally independent of each other, said set of two of the riveted holes for each finger loop of the plurality of loops are horizontal relative to the circumferential band, each finger loop being elastic such that a finger may pull each finger loop outward and upward from the circumferential band with a natural state of each finger loop being returned to upon its release, each finger loop providing a space for a finger to be inserted to pull the loop to lift or lower the lower body garment relative to a body of the user.

19. The assistive garment of claim 18, wherein the riveted holes include at least one of rivets, grommets, or eyelets.

20. The assistive garment of claim 18, wherein the securement attaches alternating finger loops to the band, such that corresponding alternating finger loops are are configured to be pulled independently with respect to each other.

* * * * *